US008065802B2

(12) United States Patent
Oglesby et al.

(10) Patent No.: US 8,065,802 B2
(45) Date of Patent: Nov. 29, 2011

(54) SHAVING RAZOR

(75) Inventors: Oliver David Oglesby, Basingstoke and Dean (GB); Sean Peter Clarke, Highmoor Cross (GB); Terence Gordon Royle, Baskingstoke (GB); Luke Richard Stone, Reading (GB); Laurence John Robinson, Royston (GB); John James Wlassich, Boston, MA (US)

(73) Assignee: The Gillette Company, Boston, MA (US)

( * ) Notice: Subject to any disclaimer, the term of this patent is extended or adjusted under 35 U.S.C. 154(b) by 54 days.

(21) Appl. No.: 11/486,642

(22) Filed: Jul. 14, 2006

(65) Prior Publication Data

US 2008/0010834 A1 Jan. 17, 2008

(51) Int. Cl.

| | |
|---|---|
| ***B26B 21/00*** | (2006.01) |
| ***B26B 21/08*** | (2006.01) |
| ***B26B 21/40*** | (2006.01) |
| ***B26B 19/46*** | (2006.01) |
| ***B26B 21/46*** | (2006.01) |

(52) U.S. Cl. ..... 30/50; 30/32; 30/537; 362/115

(58) Field of Classification Search ..... 30/32, 34, 30/34.05, 526, 537; 362/115

See application file for complete search history.

(56) References Cited

U.S. PATENT DOCUMENTS

| | | | | |
|---|---|---|---|---|
| 1,168,288 | A | | 1/1916 | Davidson |
| 1,180,686 | A | | 4/1916 | Allport |
| 1,223,305 | A | | 4/1917 | Allport |
| 1,429,760 | A | | 9/1922 | Norquist |
| 1,440,325 | A | | 12/1922 | Wilhelm |
| 1,554,159 | A | | 9/1925 | Hodges |
| 1,676,183 | A | | 7/1928 | Garfunkle |
| 1,693,348 | A | | 11/1928 | Pollifrone |
| 1,862,274 | A | | 6/1932 | Mendelsohn |
| 1,900,965 | A | | 3/1933 | Weiss |
| 1,950,789 | A | | 3/1934 | Eells |
| 2,225,405 | A | | 12/1940 | Osterman |
| 2,262,392 | A | * | 11/1941 | Dalkowitz ..... 362/115 |
| 2,288,183 | A | * | 6/1942 | Dalkowitz ..... 310/47 |
| 2,309,035 | A | | 1/1943 | Beam |
| 2,546,928 | A | | 3/1951 | Masabny |
| 2,806,492 | A | * | 9/1957 | Becker ..... 83/520 |
| 4,094,062 | A | * | 6/1978 | Papanikolaou ..... 30/34.05 |
| 4,473,943 | A | * | 10/1984 | Papanikolaou ..... 30/34.05 |

(Continued)

FOREIGN PATENT DOCUMENTS

DE 202 01 967 U1 5/2002

(Continued)

OTHER PUBLICATIONS

PCT International Search Report dated Nov. 23, 2007, 12 pages.

*Primary Examiner* — Ghassem Alie

*Assistant Examiner* — Bharat C Patel

(74) *Attorney, Agent, or Firm* — John M. Lipchitz; Kevin C. Johnson; Steven C. Miller

(57) ABSTRACT

A shaving razor has a housing joined to a handle, one or more blades mounted in the housing and a light source. The light source projects a defined image indicating the exact location of a blade edge on the skin of a user enabling the user to properly align the blade edge on the skin during shaving.

10 Claims, 9 Drawing Sheets

U.S. PATENT DOCUMENTS 4,531,287 A 7/1985 Shibata et al.
4,602,143 A * 7/1986 Mack et al. ..... 219/225
4,611,400 A 9/1986 Drake
4,669,817 A * 6/1987 Mori ..... 398/98
5,121,541 A 6/1992 Patrakis
5,133,131 A * 7/1992 Hoffman ..... 30/50
5,299,104 A 3/1994 Parmentier
5,347,714 A * 9/1994 Prochaska ..... 30/41.5
5,347,715 A 9/1994 Friedland
5,533,266 A * 7/1996 Kelman ..... 30/122
5,582,476 A * 12/1996 Hansen ..... 362/115
5,675,899 A * 10/1997 Webb ..... 30/390
5,727,319 A * 3/1998 Myerchin et al. ..... 30/123
5,993,440 A 11/1999 Ghassemi
5,996,460 A * 12/1999 Waite ..... 83/520
6,009,623 A 1/2000 Orloff
6,067,714 A 5/2000 Taylor et al.
6,161,288 A * 12/2000 Andrews ..... 30/50
6,227,676 B1 5/2001 Sneddon
6,238,076 B1 5/2001 Pascale et al.
6,276,061 B1 * 8/2001 Rozenkranc ..... 30/34.1
6,406,157 B1 6/2002 Audet
6,430,813 B2 8/2002 Muraguchi et al.
6,449,849 B1 * 9/2002 Hackerman ..... 30/50
6,460,251 B1 10/2002 Orloff
6,481,104 B1 * 11/2002 Parker et al. ..... 30/45
6,481,322 B1 * 11/2002 Hsiung ..... 83/521
6,497,043 B1 12/2002 Jacobsen
6,533,775 B1 3/2003 Rizoiu
6,634,104 B2 10/2003 Jacobsen
6,915,576 B2 * 7/2005 Brzezinski ..... 30/34.05
2001/0025421 A1 10/2001 Damstra
2002/0088121 A1 7/2002 Jacobsen
2002/0189102 A1 12/2002 Orloff
2003/0140758 A1 * 7/2003 Weusthof et al. ..... 83/490
2003/0167638 A1 9/2003 Bader et al.
2003/0226258 A1 12/2003 Patrick
2004/0055156 A1 * 3/2004 Brown, Jr. ..... 30/34.1
2004/0083869 A1 * 5/2004 Aziz et al. ..... 83/520
2005/0022386 A1 * 2/2005 Macove ..... 30/50
2005/0034307 A1 2/2005 Brzezinski
2005/0188808 A1 * 9/2005 Parrish et al. ..... 83/522.11
2006/0176682 A1 * 8/2006 Wu et al. ..... 362/119
2006/0179990 A1 * 8/2006 Ushiwata et al. ..... 83/581
2006/0218804 A1 * 10/2006 Noble et al. ..... 30/440
2006/0277768 A1 * 12/2006 van Rijen et al. ..... 30/388
2007/0017326 A1 * 1/2007 Long et al. ..... 83/13
2007/0227017 A1 * 10/2007 Milligan et al. ..... 33/228
2007/0277378 A1 * 12/2007 Kabella ..... 30/29

FOREIGN PATENT DOCUMENTS

EP 504745 A1 * 9/1992
FR 1 046 876 12/1953
FR 2 188 485 A 1/1974
FR 2 543 046 A 9/1984
GB 2 361 889 A 11/2001

* cited by examiner

SHAVING RAZOR

FIELD OF THE INVENTION

The present invention relates to shaving razors and more particularly to shaving razors having a light source that projects an image onto the skin indicating the location of a blade edge on the skin of a user enabling the user to properly align the blade edge on the skin during shaving.

BACKGROUND OF THE INVENTION

In recent years shaving razors with numerous blades have been proposed in the literature and commercialized, e.g., in United States 2005/0039337 A1 published on Feb. 24, 2005, which generally describes a type of design that has been commercialized as the five bladed Fusion™ razor by The Gillette Company.

Increasing the number of blades on a shaving razor generally tends to increase the shaving efficiency of the razor and provide better distribution of compressive forces on the skin but can reduce the ability to trim, e.g., sideburns or near the nose. In order to improve the ability to trim an extra blade mounted on the rear of the razor cartridge has been provided. Such a design with an extra blade is described in United States 2005/0039337 A1 and commercialized in the Fusion™ razor by The Gillette Company.

While a trimming blade is very useful for trimming hair of the sideburn or near the nose, it is difficult to locate the exact location of the trimming blade as the trimming blade is hidden from view by the razor cartridge. When hidden it is difficult for the user to accurately position the trimming blade on the skin for precise trimming. The inability to accurately position the trimming blade can result in a less than accurate shave producing a less than satisfactory shaving experience.

It is therefore desirable to provide the shaving razor with a light source that projects an image onto the skin that indicates the location of the trimming blade on the skin of the user enabling the user to properly align the trimming blade on the skin during shaving.

SUMMARY OF THE INVENTION

In one aspect, the invention features, in general, a shaving razor including a housing joined to a handle, one or more blades mounted in the housing, and a light source, each of the blades includes a blade edge, the light source projects a defined image indicating the location of one of the blade edges on the skin of a user enabling proper alignment of the blade edge during shaving. The defined image may be a line segment or a plurality of line segments.

The defined image may project from the housing or may project from the handle. The defined image may project continuously or intermittently. The defined image may be projected directly on the skin. The defined image may be projected onto a reflective surface and then on the skin, i.e., projected indirectly on the skin.

The light source may be a high illumination element or multiple high illumination elements. The high illumination element may be an electrically activated component. The light source may be selected from the group consisting of a light emitting diode, a laser, a halogen bulb, or a luminescent bulb. The light source may project multiple defined images indicating the location of multiple blade edges on the skin of the user.

The shaving razor may be a dry razor or a wet razor.

DETAILED DESCRIPTION OF THE INVENTION

Figure 1:
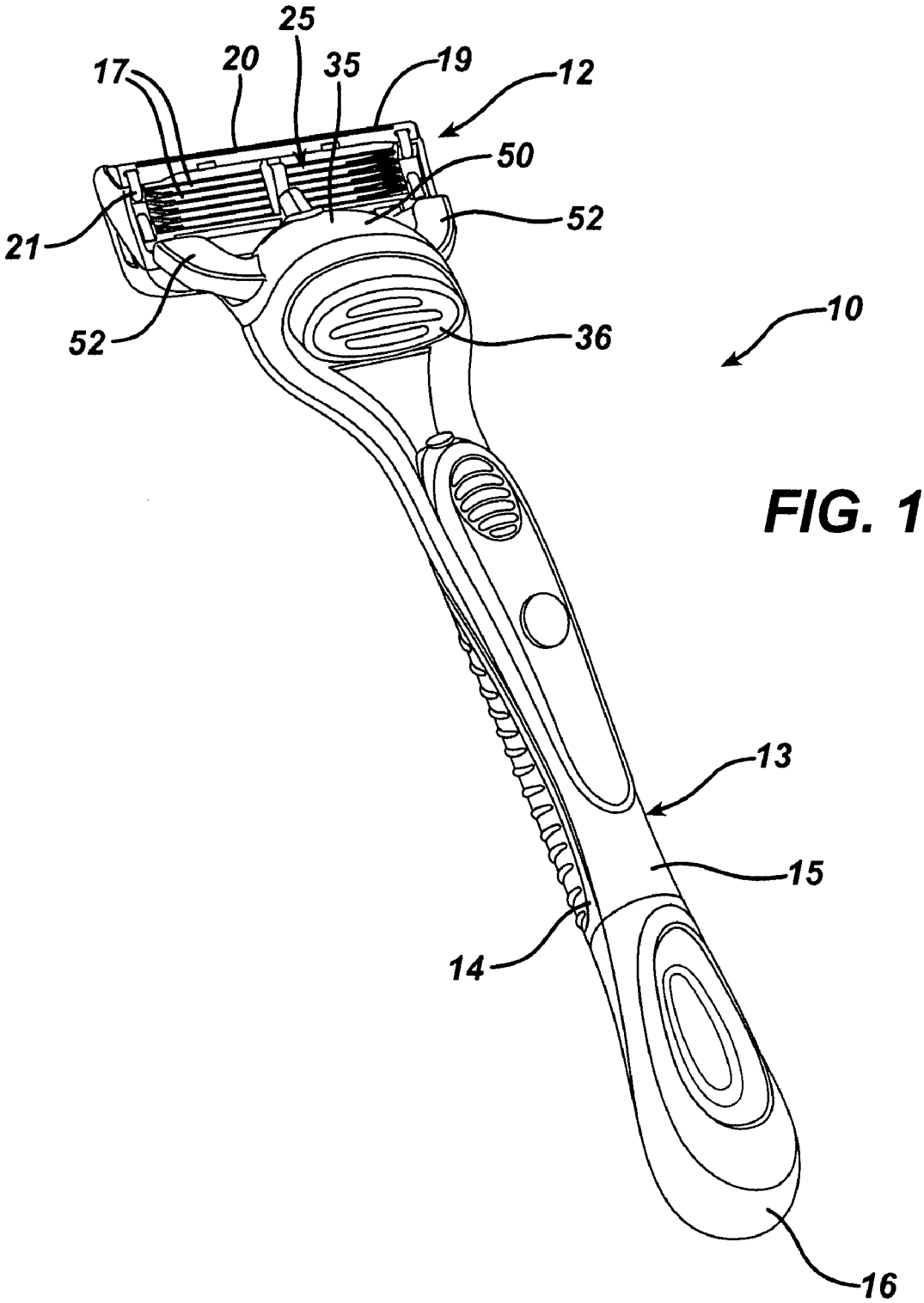
FIG. 1 is a perspective view of a wet shaving razor.
Figure 2:
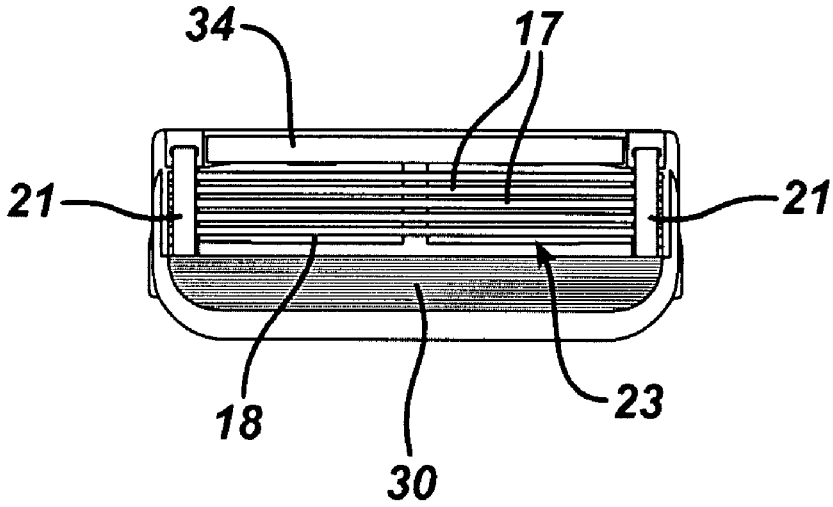
FIG. 2 is a plan view of the front or first side of the housing of the shaving razor shown in FIG. 1.
Figure 3:
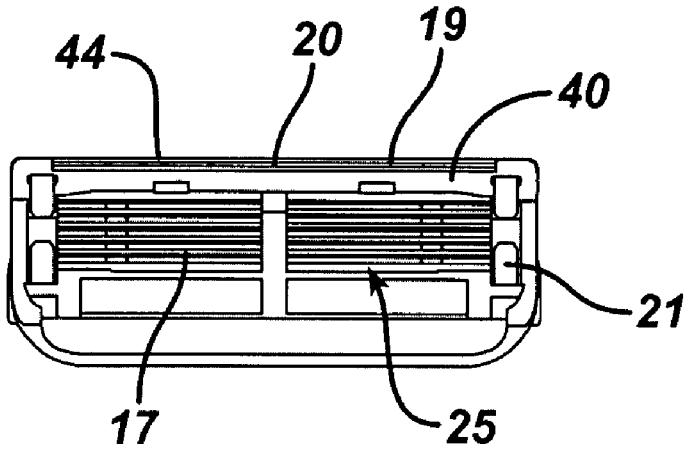
FIG. 3 is a plan view of the back or second side of the housing of the shaving razor shown in FIG. 1.

Referring to FIGS. 1-3, wet shaving razor 10 includes a housing or cartridge 12 detachably joined to handle 13. The housing 12 includes one or more first blades 17 mounted in housing 12 and a separate second or trimmer blade 19 mounted in housing 12. The blades 17 and 19 are held in the housing 12 by metal clips 21. The first blades 17 have substantially parallel sharp cutting edges 18 and extend in a first direction. The second or trimming blade 19 has a sharp cutting edge 20 that extends in a second direction different from the first direction. The first blades 17 have their cutting edges 18 on the first side 23 of housing 12 whereas the second blade 19 has its cutting edge 20 on the opposite second side 25 of housing 12.

Referring now to FIG. 1, handle 13 provides a hollow interior for other internal components. In the embodiment depicted in FIG. 1, handle 13 is formed from three separate pieces. A first piece 14 corresponds to the front side of the handle, a second piece 15 corresponds to the back side of the handle, and a third piece 16 attaches to the first and second pieces to form the tail end of the handle. In this embodiment the first piece 14 permanently affixes to the second piece 15 and the third piece 16 attaches to the first and second pieces via a bayonet attachment or other conventional attachment.

Referring now to FIG. 2, a guard structure 30 is provided on housing 12 for contacting the skin in front of blades 17 and a cap structure 34 is provided on housing 12 for contacting the skin behind blades 17 during the shaving stroke. The guard structure 30 may comprise an elastomeric material. The cap structure 34 may comprise a lubricating strip.

Referring now to FIG. 3, a guard structure 40 is provided on the housing 12 for contacting the skin in front of trimmer blade 19 and a cap structure 44 is provided on the housing 12 for contacting the skin behind blade 19 during the shaving stroke. The guard structure 40 may comprise an elastomeric material. The cap structure 44 may comprise a lubricating strip.

Referring now to FIG. 1, housing 12 is pivotally joined on a yoke member 50 having a pair of arms 52 which extend from a hub 35 and are journalled in opposite ends of housing 12 so that housing 12 can pivot relative to handle 13 about an axis substantially parallel to the blade edges. Hub 35 selectively attaches to and detaches from handle 13. Any known hub can be utilized. In this embodiment release button 36 cooperates with hub 35 such that when release button 36 is pressed inward, hub 35 is disengaged from handle 13.

Figure 4:
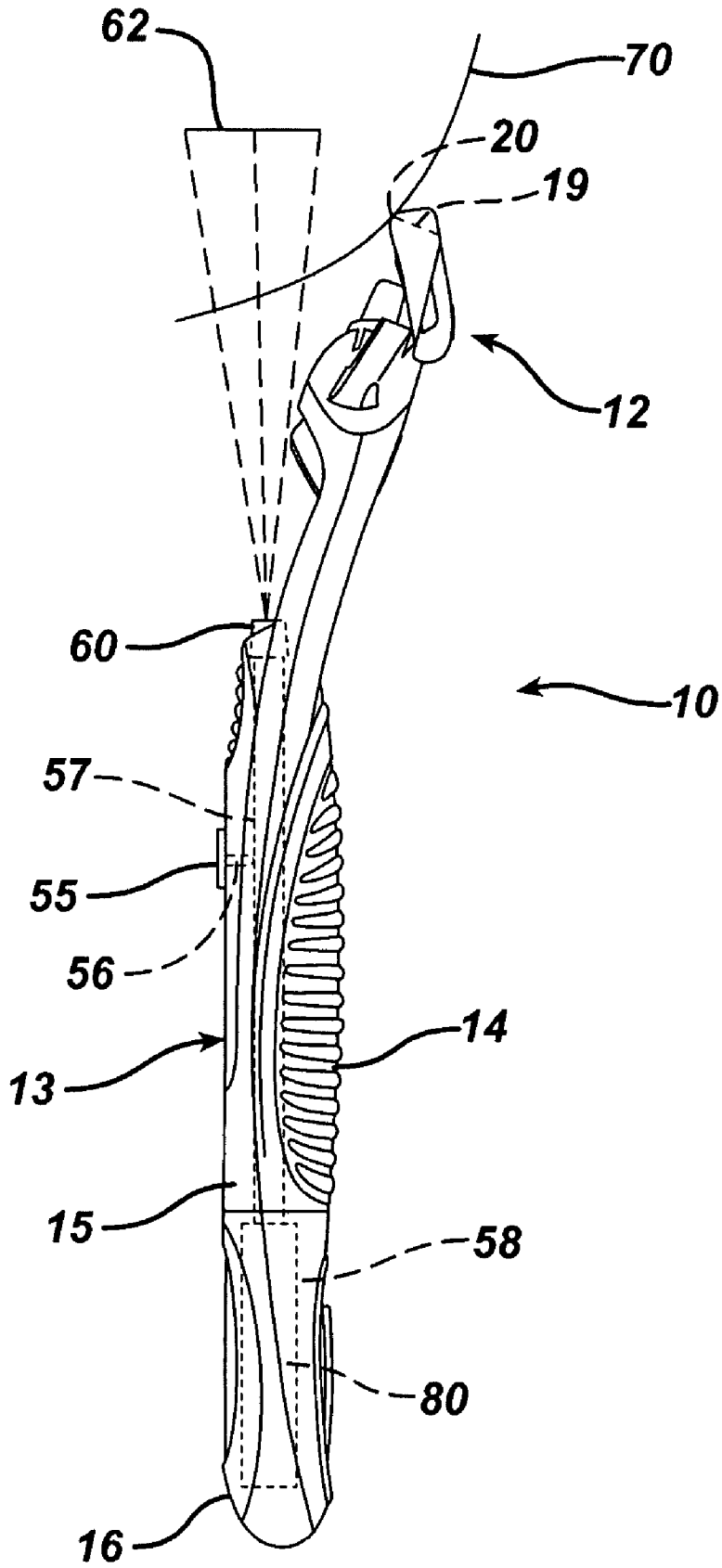
FIG. 4 shows the FIG. 1 shaving razor in a position adjacent the user's skin.

Referring now to FIG. 4, razor 10 includes a housing 12 detachably joined to handle 13. Handle 13 includes a light source 60. Light source 60 projects a defined image 62 from handle 13, such as a line segment, onto the skin 70 of the user. The defined image 62 indicates the location at which blade edge 20 of blade 19 will contact the skin 70 of the user. This enables the user to properly align blade edge 20 on the skin for accurate shaving of the hair. The dimensions of the line segment can be optimized as desired.

Light source 60 is powered by a power source 80. Power source 80 may be any conventional power source such as a AA size battery or a AAA size battery. The power source 80 may be optimized to provide the necessary power for the light source selected. The handle 13 defines a power source compartment 58 that is adapted to receive a AAA battery. The power source compartment 58 may be sized differently so that it can receive a different sized battery and/or power source. The power source 80 is accessible by removing the third piece 16 from the first piece 14 and second piece 15 of handle 13.

The light source may be manually activated by any normal means including a button or switch or automatically activated upon retrieval from organizer or utilize sensors such as proximity sensors to activate the light source when in close proximity with the face. The user can then be given the option of letting the light source run automatically during the shave or taking manual control over the activation or deactivation of the light source. In the embodiment shown, the light source 60 is activated by a button 55 which activates a switch 56 to selectively open and close circuit 57 to provide power from power source 80 to light source 60. Button 55 is located on the second piece 15 of handle 13. The button 55 may be located in alternative locations.

Figure 5:
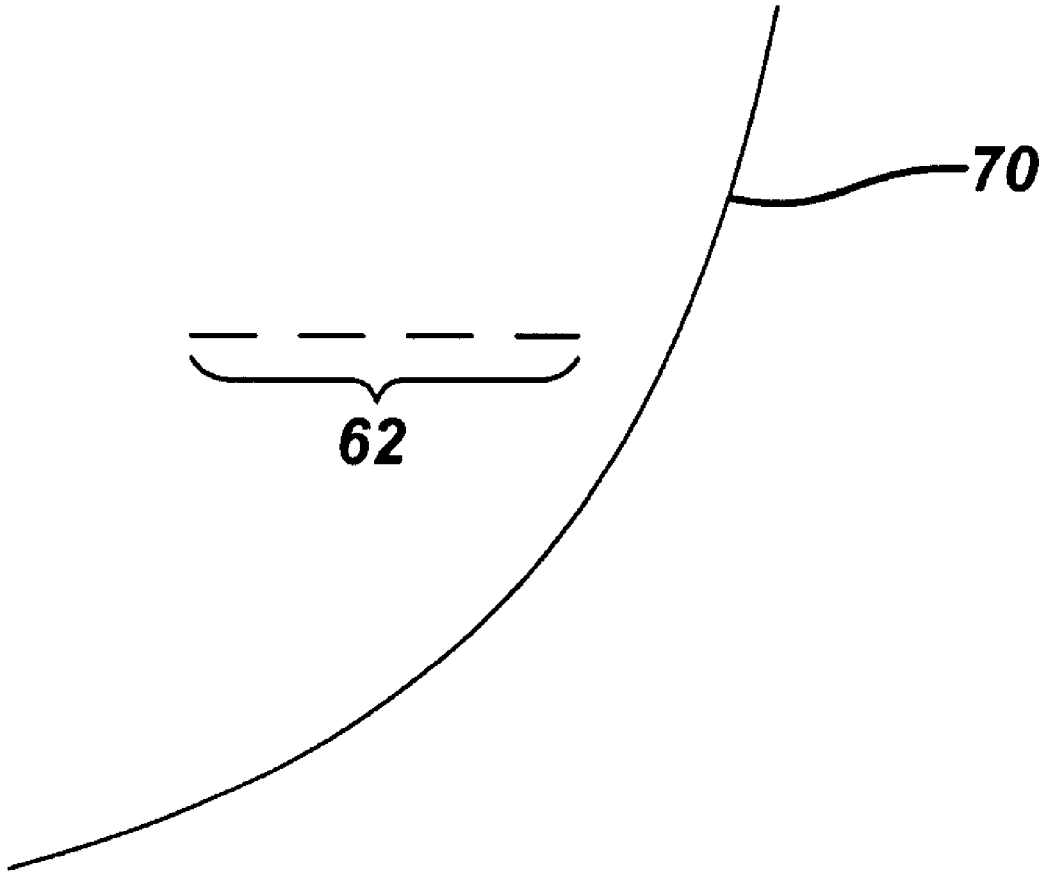
FIG. 5 shows an embodiment of another defined image.

In FIG. 4 the defined image 62 is a line segment. The defined image 62 may be a plurality of line segments projected onto skin 70 as shown in FIG. 5. The size of each line segment, the spacing between line segments and the number of line segments can be optimized as desired. While a line or line segments are preferred, the defined image may be other configurations suitable for indicating the location of a blade edge on the skin.

The defined image may be projected onto the skin as a single color, e.g., red, black, green, blue, etc. The defined image may be projected on the skin as a combination of two or more colors, e.g., red and green, red and blue, or red, yellow and green, etc.

The defined image may be projected onto the skin in a continuous manner or intermittently. If an intermittent projection is selected the duration of the projection cycle and the duration of the rest cycle can be selected as desired. The intermittent projection may be such that the projection cycle and the rest cycle are of the same duration or different durations with either the projection cycle or the rest cycle being longer in duration.

The light source may be a high illumination element or multiple high illumination elements. The light source may be a light emitting diode, a laser, a halogen bulb, or a luminescent bulb. The light source may also be multiple light emitting diodes, multiple lasers, multiple halogen bulbs or multiple luminescent bulbs.

Figure 6:
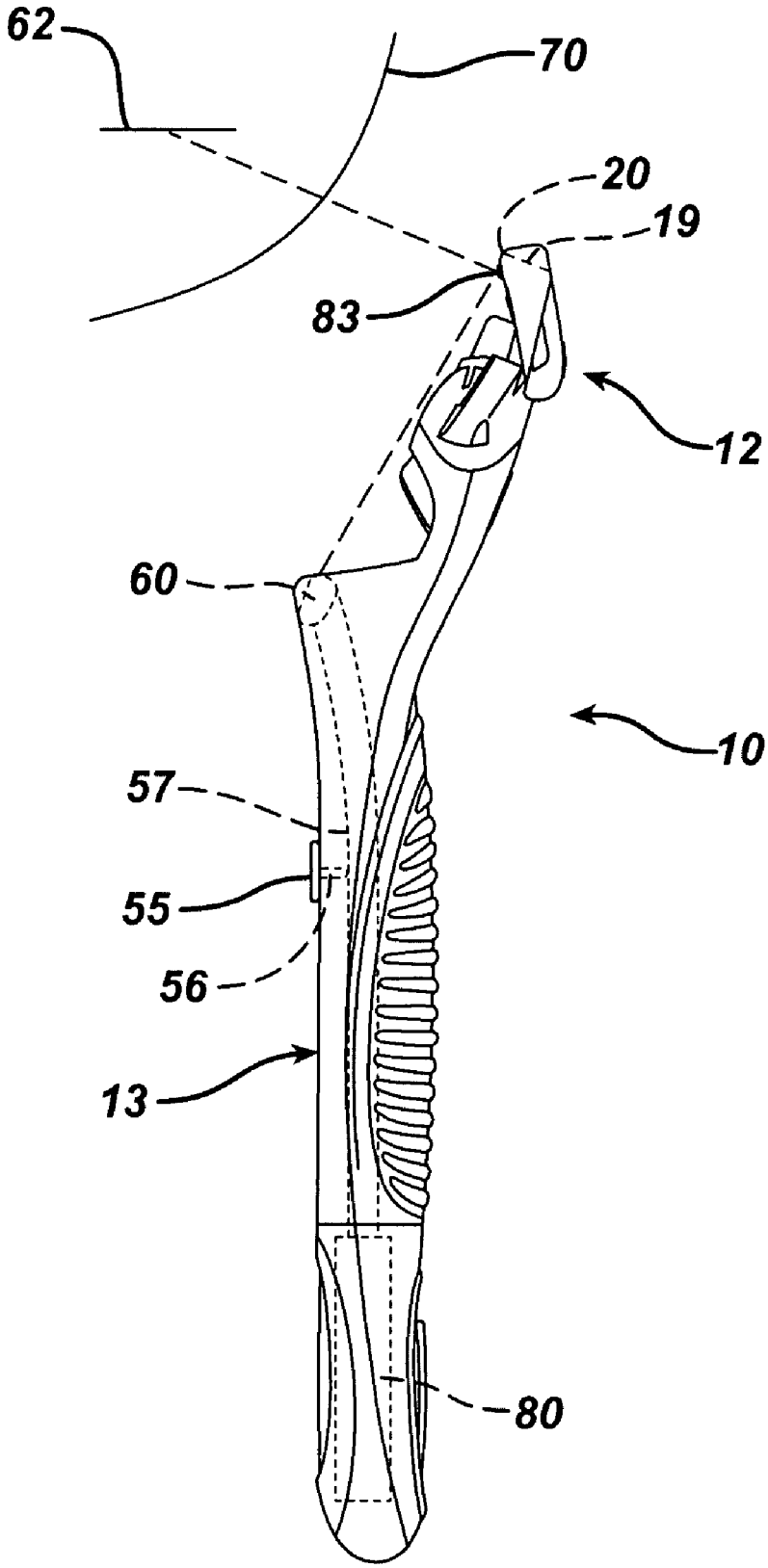
FIG. 6 shows an alternative embodiment of a wet shaving razor in a position adjacent the user's skin.

In the embodiment of FIG. 4, the defined image 62 is projected directly onto the skin 70. Referring now to FIG. 6, there is shown a shaving razor 10. Shaving razor 10 includes a housing 12 detachably joined to handle 13. Handle 13 includes a light source 60 powered by power source 80. Light source 60 is activated by a button 55 which activates a switch 56 to selectively open and close circuit 57 to provide power from power source 80 to light source 60. Light source 60 projects an image onto reflective surface 83 located near the top of housing 12 just below blade edge 20 of trimming blade 19. The image reflects off of reflective surface 83 onto the user's skin 70 resulting in defined image 62 being projected indirectly onto skin 70. Alternatively, the reflective surface 83 may be located just above the blade edge 20 of trimming blade 19. Options for the power source, light source, defined image and light source activation remain as before.

Figure 7:
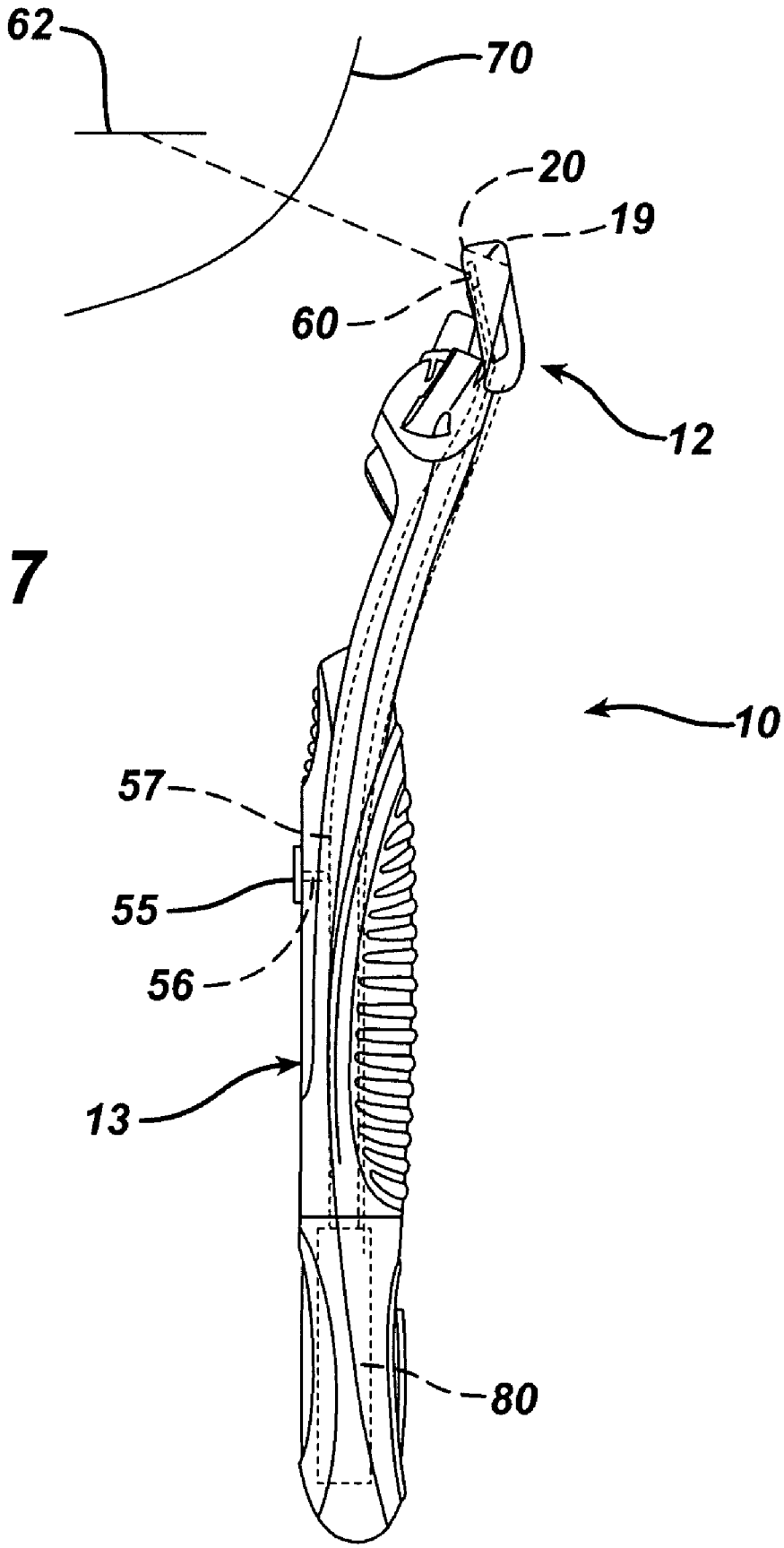
FIG. 7 shows an alternative embodiment of a wet shaving razor in a position adjacent the user's skin.

Referring now to FIG. 7 there is shown a shaving razor 10. Shaving razor 10 includes a housing 12 detachably joined to handle 13. Housing 12 includes a light source 60. Light source 60 is powered by power source 80 located in handle 13. Light source 60 projects from housing 12 a defined image 62 directly onto the user's skin 70. The defined image 62 indicates the location at which blade edge 20 of blade 19 will contact the skin 70 of the user. The power source 80 is in electrical communication with light source 60 via circuit 57. A slidable button 55 is moved back and forth to activate switch 56 to selectively open and close circuit 57 to provide power from power source 80 to light source 60.

Figure 8:
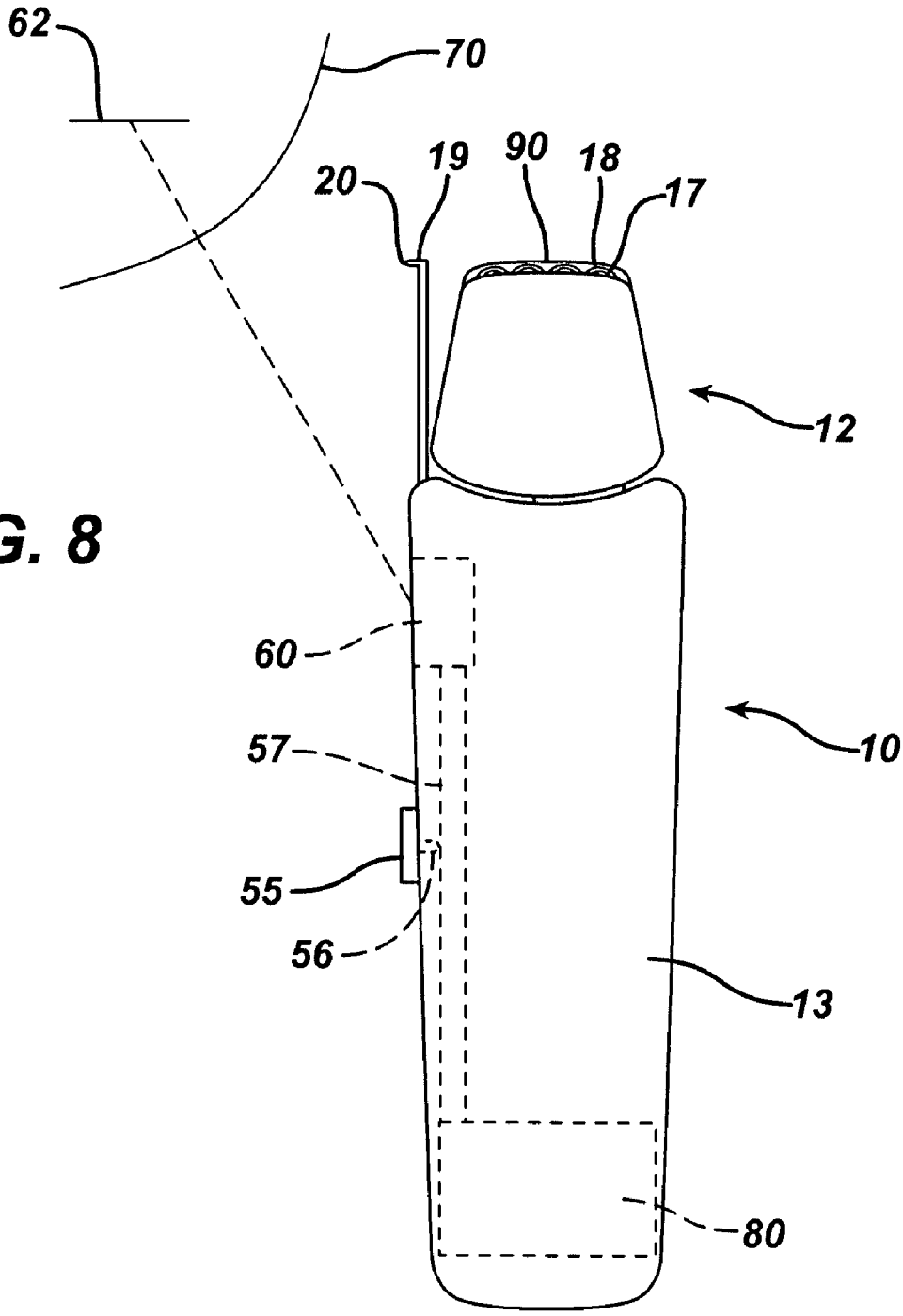
FIG. 8 shows an alternative embodiment of a dry shaving razor in a position adjacent the user's skin.

Referring to FIG. 8, dry shaving razor 10 includes a housing or cartridge 12 detachably joined to handle 13. The housing 12 includes one or more first blades 17 mounted in housing 12 and a separate second or trimmer blade 19 mounted in housing 12. The first blades 17 are positioned beneath a protective foil 90. First blades 17 oscillate in a back and forth motion. First blades 17 have sharp cutting edges 18. The second or trimming blade 19 is mounted on the housing 12 and has a sharp cutting edge 20.

Handle 13 includes a light source 60. Light source 60 is activated by button 55 which activates switch 56 to selectively open and close circuit 57 to provide power from power source 80 to light source 60. Light source 60 projects a defined image 62 from handle 13, such as a line segment, onto the skin 70 of the user. The defined image 62 is to indicate the exact location at which blade edge 20 of blade 19 will contact the skin 70 of the user. This enables the user to properly align blade edge 20 on the skin for accurate shaving of the hair.

Preferably the power source 80 is a rechargeable power source. Power source 80 also provides power for first blade 17 and trimmer blade 19. The first blades 17 and trimmer 19 may be activated by the same switch that activates light source 60, independent switches or combinations thereof.

Figure 9:
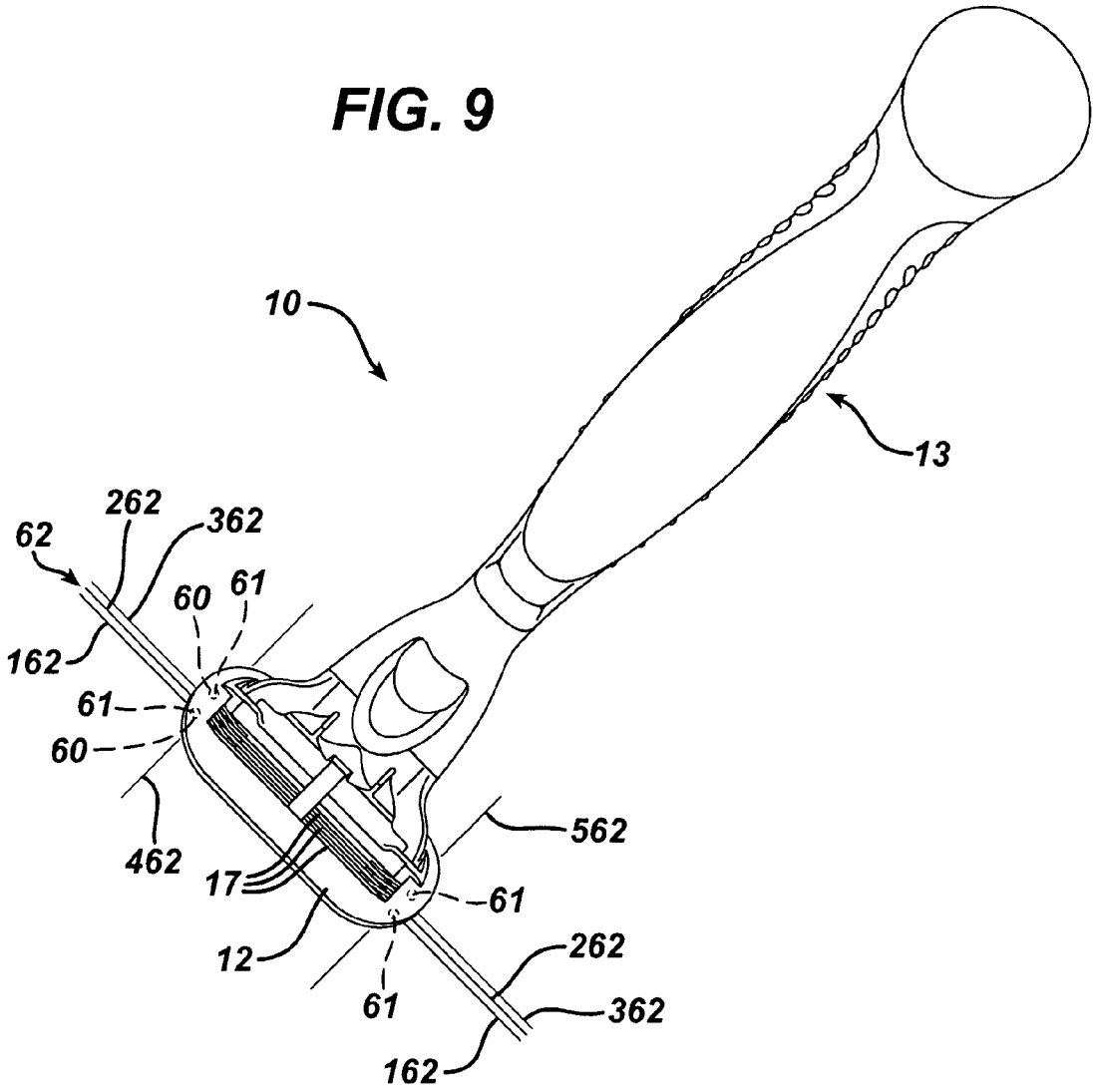
FIG. 9 shows an alternative embodiment of a wet shaving razor.

Referring now to FIG. 9 shaving razor 10 includes a housing 12 detachably joined to handle 13. The housing includes three blades 17 mounted in housing 12. The housing 12 includes a light source 60 made up of multiple high illumination elements 61. The multiple high illumination elements 61 project multiple defined images 62 from housing 12 onto the skin. As can be seen, three defined images 162, 262 and 362 are projected from housing 12 onto the skin to coincide with each of the three blades mounted in housing 12. Two additional defined images 462 and 562 are projected from housing 12 onto the skin to indicate the respective ends of the blades cutting surfaces. The power source for illumination elements 61 may be located in the housing 12 or in the handle 13. Options for the power source, light source, defined image and light source activation remain as before.

Figure 10:
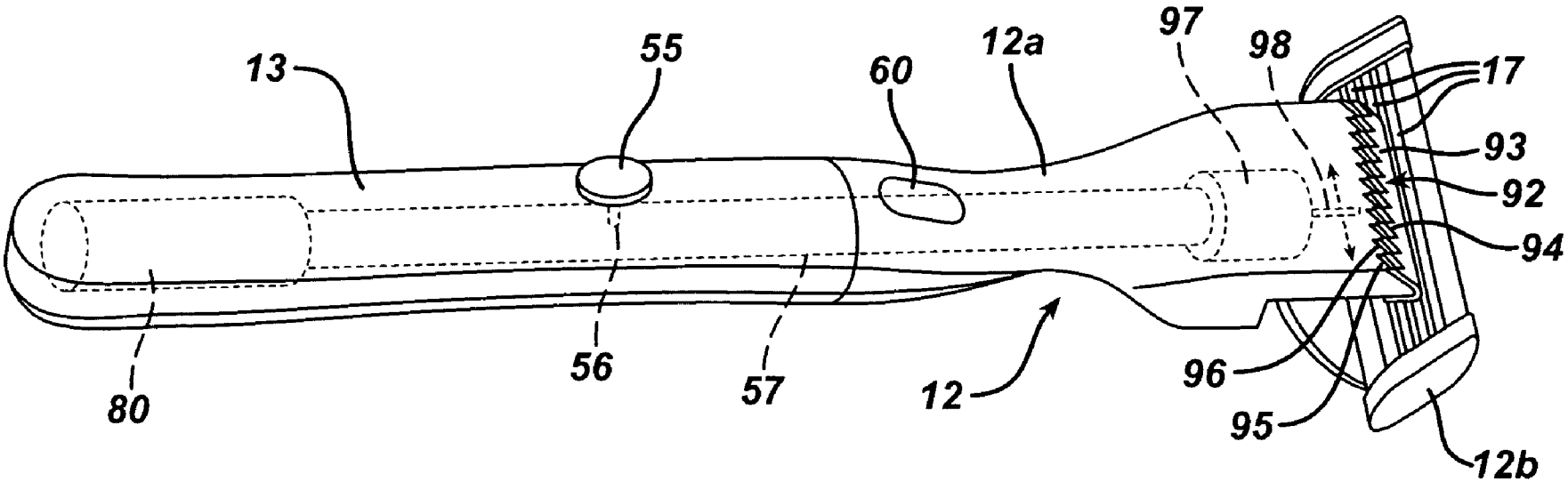
FIG. 10 shows an alternative embodiment of a wet shaving razor.

Referring now to FIG. 10, shaving razor 10 includes a housing 12 joined to a handle 13. The housing 12 is a two piece construction containing a first housing portion **12*a* and a second housing portion 12***b*. Housing portion 12*a* is joined directly to handle 13 and housing portion 12*b* is joined indirectly to handle 13 through housing portion 12*a*. Housing portion 12*b* is detachably joined to housing portion 12*a*. Housing portion 12*b* includes blades 17 mounted therein. Housing portion 12*a* has a powered trimmer 92 with a first moving blade 93 having a blade edge 94 and a second stationary blade 95 having a blade edge 96. The housing portion 12*a* includes a light source 60 which projects a defined image onto the skin of the user indicating the location of blade edge 94.

The light source 60 and motor 97 are powered by power source 80. Light source 60 and motor 97 are activated by button 55 which activates switch 56 to selectively open and close circuit 57 to provide power from power source 80 to light source 60 and motor 97. An arm 98 extends from motor 97 to first moving blade 93 oscillating back and forth to oscillate first moving blade 93 in a back and forth motion.

The powered trimmer 92 can either be fixed to the housing portion 12*a* or project out from the housing portion 12*a* by any means including sliding, flipping or twisting into position for best use. The blade edges 94 and 96 of the trimmer 92 are of a toothed configuration. The light source can then be positioned in accordance with the position of the trimmer 92.

Generally, in order to focus the defined image emanating from the light source a lens or lenses may be used. A lens can be used to adjust the depth of field and depth of focus of the defined image on the user's skin to optimize performance. The lens may be part of the light source itself or a separate member.

The projection of the defined image onto the skin of the user may have other benefits than identify the location of a blade or blade. The projection of the defined image onto the user's skin may also provide some benefits in aiding the user to place the housing or cartridge against the user's skin at the proper angle.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor comprising:

a handle having a light source powered by a power source;

a cartridge detachably joined to the handle;

a plurality of first blades mounted on the cartridge, each of the plurality of first blades having a cutting edge on a first side of the cartridge;

a trimmer blade mounted on the cartridge, the trimmer blade having a cutting edge on a second side of the cartridge, opposite the first side of the cartridge; and a reflective surface located on a top surface of the cartridge just below the cutting edge of the trimming blade, wherein the light source projects an image onto the reflective surface, the reflective surface reflecting the image onto a user's skin resulting in a line segment being projected indirectly onto the user's skin indicating the location of the cutting edge of the trimming blade enabling proper alignment of the cutting edge of the trimming blade during shaving.

2. The shaving razor according to claim 1, wherein the reflective surface reflecting the image onto a user's skin results in a plurality of line segments being projected indirectly onto the user's skin indicating the location of the cutting edge of the trimming blade enabling proper alignment of the cutting edge of the trimming blade during shaving.

3. The shaving razor according to claim 1, wherein the light source comprises a high illumination element.

4. The shaving razor according to claim 1, wherein the line segment is projected intermittently.

5. The shaving razor according to claim 1, wherein the light source is selected from the group consisting of a light emitting diode, a laser, a halogen bulb, or a luminescent bulb.

6. The shaving razor according to claim 1, wherein the shaving razor is a wet razor.

7. The shaving razor according to claim 1, wherein the cartridge is pivotably joined to the handle.

8. The shaving razor according to claim 1, wherein the high illumination element comprises an electrically activated component.

9. The shaving razor according to claim 1, wherein the line segment is projected onto the skin in a continuous manner.

10. The shaving razor according to claim 1, wherein the line segment is projected onto the skin in a intermittent manner.

* * * * *